US005671553A

United States Patent [19]

Burkhart

[11] Patent Number: 5,671,553

[45] Date of Patent: Sep. 30, 1997

[54] GRADING APPARATUS

[76] Inventor: Glenn E. Burkhart, 4643 Oakbough Way, Carmichael, Calif. 95608

[21] Appl. No.: 437,572

[22] Filed: May 9, 1995

[51] Int. Cl.[6] ..... E01H 5/06; E01H 5/02

[52] U.S. Cl. ..... 37/270; 37/284; 37/285; 172/372; 172/375; 294/59

[58] Field of Search ..... 37/284, 285, 270, 37/274; 172/371, 372, 375; 224/49, 50.7, 58, 59, 60; 15/235.8, 235.7, 236.06, 236.09; 33/624

[56] References Cited

U.S. PATENT DOCUMENTS

| | | | |
|---|---|---|---|
| 834,030 | 10/1906 | Sutton | 33/624 X |
| 856,575 | 6/1907 | Elliott | 294/49 |
| 1,027,345 | 5/1912 | Lapin | 294/49 |
| 1,783,026 | 11/1930 | Ober | 294/59 X |
| 2,447,216 | 8/1948 | Tidwell | 294/49 X |
| 3,571,838 | 3/1971 | Stasechke | 15/236.09 |
| 4,198,090 | 4/1980 | Gutman | 294/58 |
| 4,215,495 | 8/1980 | Wagner | 172/239 X |
| 4,428,436 | 1/1984 | Johnson | 172/372 |
| 4,804,219 | 2/1989 | Berg | 294/59 X |
| 4,837,940 | 6/1989 | Mahan | 172/797 X |
| 5,310,231 | 5/1994 | Burkhart | 294/59 |
| 5,350,021 | 9/1994 | Walker | 172/371 X |
| 5,352,113 | 10/1994 | Alvarez | 15/235.7 X |

FOREIGN PATENT DOCUMENTS

| | | | |
|---|---|---|---|
| 120185 | 9/1946 | Sweden | 294/60 |

*Primary Examiner*—Randolph A. Reese
*Assistant Examiner*—Thomas A. Beach
*Attorney, Agent, or Firm*—John P. O'Banion

[57] ABSTRACT

An apparatus for grading soil or dirt adjacent to a curb, gutter, or other structure. The apparatus includes a blade portion, a handle portion, and a guide which may be attached to the handle or blade portions. The guide can be positionally adjusted relative to the blade portion to set the depth of penetration of the blade into soil. The guide is placed along the curb or gutter when the apparatus is used, with the guide controlling the depth of the blade.

16 Claims, 8 Drawing Sheets

GRADING APPARATUS

BACKGROUND OF THE INVENTION

1. Field of the Invention

The present invention pertains generally to devices and methods for determining and controlling the depth to which soil or dirt is graded, leveled or removed, and more particularly to a grading apparatus which removes soil or other material to a predetermined depth to provide a uniform surface or grade adjacent to an external structure such as a curb or gutter.

2. Description of the Background Art

When roads and highways are constructed, a curb and gutter or other boundary structure is generally formed first. A road bed is then graded prior to laying the road surface or asphalt concrete. In order to bring the subgrade or aggregate base of the road bed adjacent to the curb to a specified elevation or level, a laborer is required to grade dirt, aggregate, or other debris from the area adjacent to the gutter which is integral with the curb. This grading is generally carried out manually because the grader or other mechanical equipment required to complete the grade cannot move close enough to the gutter to remove the dirt or debris without damaging the previously constructed curb and gutter. The laborer is required to continually employ a measuring instrument to locate or determine the depth of the soil or debris to be graded. Typically, such depth determination is carried out by a laborer by inserting the measuring instrument into the soil. After measuring the depth, the laborer grades and/or removes the aggregate, repeating this procedure along the entire length of the previously formed curb and gutter. This procedure is time consuming, unprecise, and labor intensive. The time consuming and back breaking nature of the current manner carrying out this work is due to the repetitious bending and straightening required by the laborer. The inaccuracy is due to differing depth resulting from each penetration of the measuring instrument. This inaccuracy is compounded if the intervals that the measuring instrument is used is infrequent, which can result from laborer fatigue and/or time pressure associated with a construction project.

My prior patent, U.S. Pat. No. 5,310,231 discloses a shovel depth determiner which addresses the time, labor, and inaccuracy of shovel depth determination associated with removing debris adjacent a curb and gutter prior to road construction. It is respectfully stipulated, however, that this patent does not teach or render obvious, singly or when considered in combination with any other references, the claimed invention.

SUMMARY OF THE INVENTION

The present invention pertains to devices for grading or leveling dirt, soil, gravel, or like material. The invention is a grading apparatus which fixes the depth to which a blade will penetrate through soil or debris, so that a level grade or surface of desired depth may be achieved. The invention is useful in the construction industry and more specifically in the construction of roads, parking areas, etc. The invention may also be employed in landscaping for preparing or cleaning away trenches or holes of predetermined depth in which sprinklers or electrical lines are to be located.

In general terms, the invention comprises soil displacing means which include a blade portion and a handle portion, guide means for adjustably positioning the blade relative to an external surface feature such as a curb, gutter, or the like, coupling means for attaching the guide means to soil displacing means, and positioning means for vertically adjusting the guide means relative to the soil displacing means.

By way of example and not of limitation, the coupling means and positioning means may be associated with the handle, blade, or other portion of the soil displacing means. The guide means may comprise many different structures and configurations, depending upon the external feature against which the guide is to be positioned. In the preferred embodiments, the guide means will generally include a downwardly disposed alignment edge or surface which is substantially flat or planar, and is generally planar with or parallel to a downwardly disposed edge on the blade of the apparatus. The positioning means may comprise, for example, a vertical slot on either the guide means, blade, or handle of the apparatus which allows slidable vertical adjustment of the guide means relative to the blade and apparatus. The coupling means preferably comprises a plurality of fasteners such as bolts or the like which may be included on the blade, guide means or handle and which associate with the vertical slot. The fasteners include fastening means for attachment in the vertical slot at a desired or predetermined position. The invention may optionally include pivoting means for adjusting the angle of the handle relative to the blade, so that the invention may be used with a pushing or pulling manner. The invention can also optionally comprise pivoting means for adjusting the angle of the blade relative to an external surface feature so that the invention may be used with a plow-like effect.

When the grading apparatus comprising the present invention is used, the depth of the soil penetration of the blade is preset so that when a laborer moves parallel to a curb or other previously constructed external feature, the grade adjacent thereto as soil and the like is removed remains constant. As the user of the invention moves parallel to a structure such as a preformed curb, he pushes away excess aggregate or soil with the shovel blade. The distance between the downward edge or surface of the guide means relative to the downward edge of the blade determines the depth to which the blade penetrates the soil and in turn clears away the soil. This distance is set by the positioning means, whereby the guide means is vertically positioned relative to the shove blade according to the height of the curb or other feature.

An object of the invention is to provide a grading apparatus which allows facile removal or grading of soil or aggregate which is adjacent to a curb, gutter, or like external surface feature.

Another object of the invention is to provide a grading apparatus which accurately removes or grades soil to a uniform grade or depth along a curb, gutter, or like feature.

Another object of the invention is to provide a grading apparatus which provides for time-efficient removal or grading of soil adjacent to a curb, gutter, or like feature.

Further objects of the invention will be brought out in the following portions of the specification, wherein the detailed description is for the purpose of fully disclosing the invention without placing limits thereon.

BRIEF DESCRIPTION OF THE DRAWINGS

The invention will be more fully understood by reference to the following drawings which are for illustrative purposes only.

DETAILED DESCRIPTION OF THE PREFERRED EMBODIMENTS

Referring more specifically to the drawings, for illustrative purposes the present invention is embodied in the grading apparatus which is generally shown in FIG. 1 through FIG. 8. It will be appreciated that the apparatus may vary as to configuration and as to details without departing from the basic concepts as disclosed herein.

Figure 1:
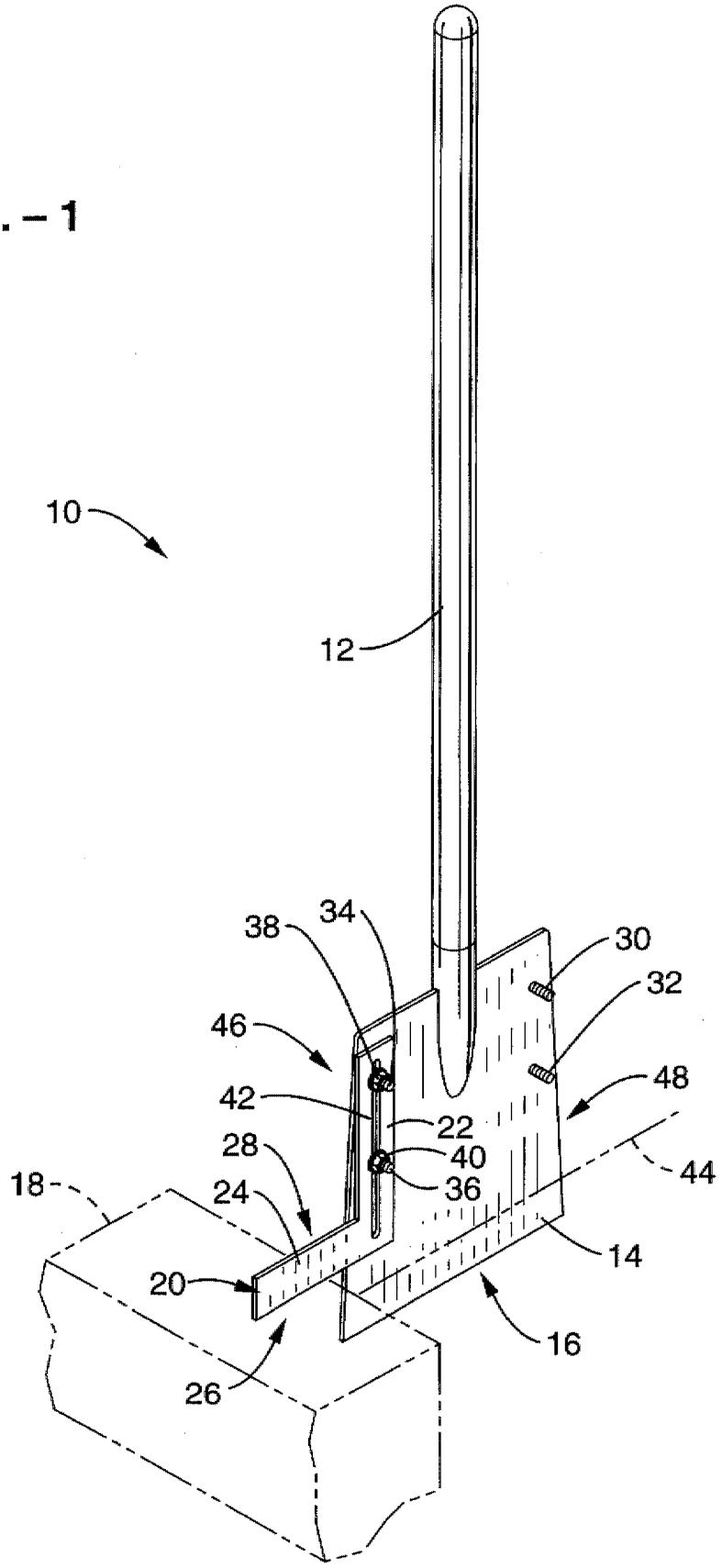
FIG. 1 is a perspective view of a grading apparatus in accordance with the present invention positioned adjacent to a curb shown in phantom.
Figure 2:
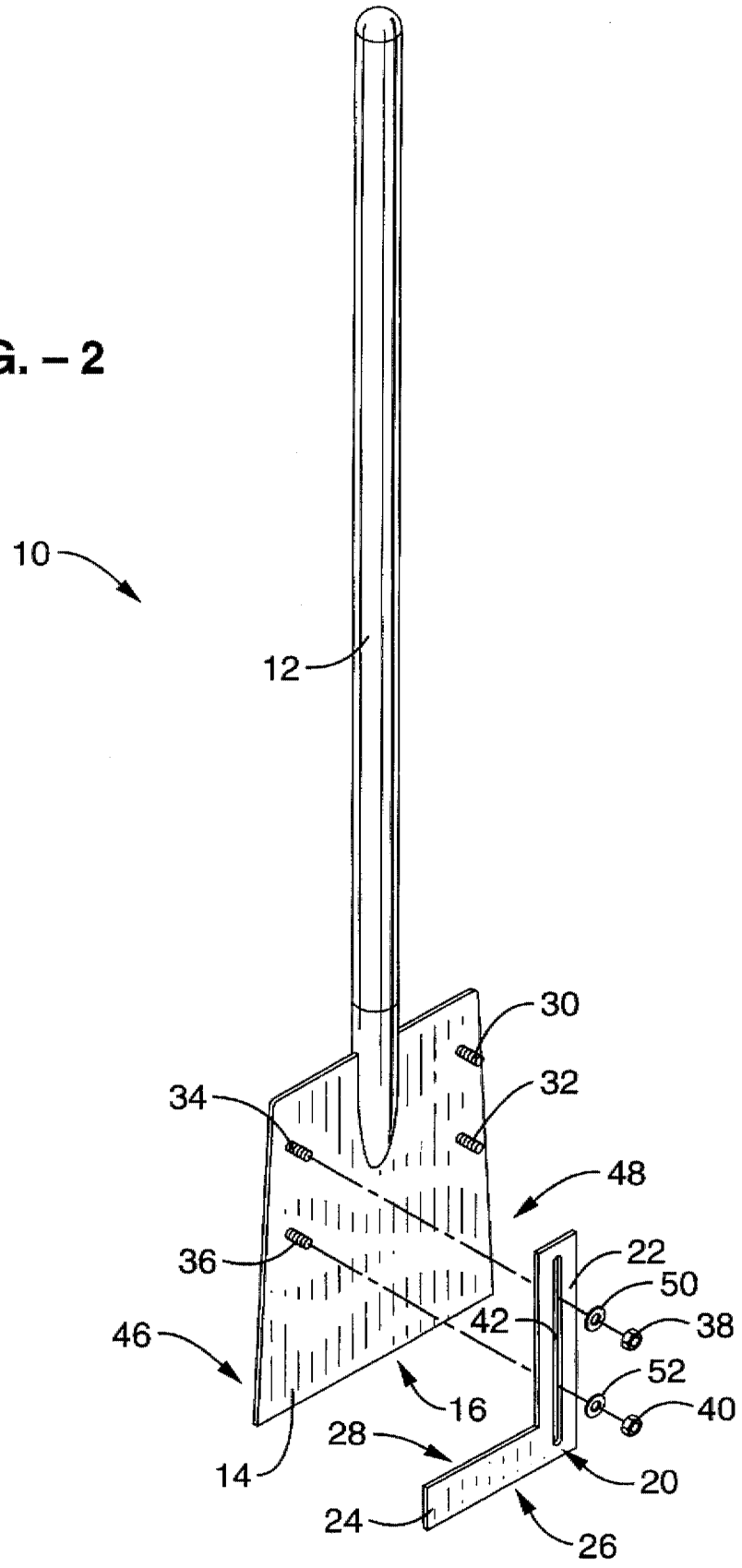
FIG. 2 is an exploded view of the apparatus shown in FIG. 1.

Referring first to FIG. 1 and FIG. 2, there is shown a first embodiment of a grading apparatus 10 in accordance with the present invention. The invention generally includes means for displacing soil, preferably in the form of a handle 12 of elongated configuration to facilitate grasping thereof by a user, and a blade 14, the blade 14 generally including a downwardly disposed edge or surface 16. The term "soil" as used in this disclosure refers generally to any form of soil, dirt, sand, gravel, aggregate, or any other material which is to be graded to a smooth surface. While handle 12 and blade 14 are shown arranged in FIG. 1 and FIG. 2 in a manner similar to a standard shovel, the handle and blade may assume many different structures and configurations, depending upon a particular grading operation to be carried out. For example, handle 12 and blade 14 may be configured at different angles to each other, in an arrangement similar to a conventional hoe, to allow a grading action by pushing or pulling the grading apparatus, as is discussed more fully below in descriptions of alternative embodiments of the invention.

The invention includes guide means for positioning blade 14 relative to an external surface feature, shown in FIG. 1 as a previously poured concrete curb or slab 18. The guide means preferably comprises a generally L-shaped guide member 20 having a vertical arm 22 and a horizontal arm 24. Horizontal arm 24 of guide 20 includes a first alignment edge or surface 26 and a second alignment edge or surface 28. The guide means provided with the invention generally includes one edge or surface which is generally parallel to or planar with the downward edge 16 of blade 14, for the purpose of aligning the guide means with curb 18, as discussed more fully below. As shown in FIG. 1 and FIG. 2, first alignment edge 26 is generally downward facing and parallel to downward edge 16 of blade 14.

The invention also comprises means for coupling the guide means to the blade 14, handle 12, or other portions of apparatus 10. The coupling means preferably comprises a plurality of fasteners on digging blade 14, shown here as bolts 30, 32, 34, 36, which are preferably oriented in a generally horizontal manner. Bolts 30, 32, 34, 36 include fastening means, an example of which are shown in FIG. 1 as nuts 38, 40 on bolts 34, 36. Other coupling means, such as reversible clips, clamps, screws, and like means commonly used in the art are also contemplated for use with the present invention for coupling the guide means to the apparatus 10.

Positioning means for vertically adjusting the position of the guide means relative to blade 14 and blade lower edge 16 are provided with the invention, and preferably comprises a vertical slot 42 in the vertical arm 22 of guide 20. Vertical slot 42 slidably accommodates bolts 34, 36, allowing guide 20 to be vertically positioned relative to blade 14. A variety of positioning means may be employed with the invention, as should be readily apparent to persons of ordinary skill in the art. For example, the guide means could be vertically positioned by a ratchet mechanism (not shown) included on handle 12 or blade 16, or the guide means could be positioned by set screws or other clamping means (not shown) on the guide means which are loosened to allow positional adjustment of the guide means and then re-tightened to affix the guide means in the adjusted position. Similarly, the positioning means need not be included on the guide means, but may alternatively be included on the blade or handle portions of the apparatus 10. For example, a vertical slot or slots can be included on handle 12 or blade 14, with the slot or slots engaging studs on the guide means, as detailed below in the alternative embodiments of the invention.

Many possible configurations are contemplated for the guide means used in the present invention, depending on the grading application to be carried out. As mentioned above, the guide means generally includes at least one downwardly disposed edge or surface which is relatively flat or planar, which is used for aligning the guide means relative to an external construction such as a curb. However, guide means which include curved or angular surfaces or edges are also contemplated for use with the present invention.

Generally, in situations where the apparatus 10 is to be employed, dirt, debris, soil, or the like must be removed or otherwise scraped away to a certain depth adjacent to an external surface feature such as a previously poured concrete gutter or curb, as related above. The distance between first alignment edge 26 and the bottom or downward edge 16 blade 14 is set to achieve soil grading or removal to a desired depth by loosening nuts 38, 40 on bolts 34, 36, so that slot 42 can slide relative to bolts 34, 36, and thus guide 20 can slide or otherwise move relative to blade 14. Guide 20 is thus slidably moved until first alignment edge 26 reaches a desired, predetermined distance relative to blade edge 16, at which point nuts 38, 40 are tightened on bolts 34, 36, thereby retaining the adjusted position of guide 20. The distance between alignment edge 26 and blade edge 16 can thus be set to achieve soil grading adjacent curb 18 to a particular desired depth. When the desired distance between alignment edge 26 and blade edge 16 is set, blade 14 will only extend into dirt or soil 44 to a desired depth. The apparatus 10 is then generally placed adjacent curb 18, as shown in FIG. 1, so that alignment edge 26 on horizontal arm 24 of guide 20 comes into contact with concrete slab 16. Further penetration by blade 14 into soil 44 is prevented by guide 20, thereby providing for quick, facile, and even grading of soil adjacent slab or curb 18 to the desired depth and providing a level surface for subsequent paving or other surface treatment.

It is frequently necessary to grade surfaces adjacent to two opposing curbs or gutters along the same roadway. The apparatus 10 as shown in FIG. 1 and FIG. 2 has guide 20 positioned for grading a curb in one direction or along one side of a roadway, and it is thus generally necessary to reposition guide 20 from a first side 46 of blade 14 to a second side 48 in order to carry out further grading on the opposite curb of a roadway. This can be easily carried out by unfastening guide 20 from bolts 34, 36 and replacing guide 18 on bolts 30, 32, and fastening guide 20 thereupon with nuts 38, 40, so that guide is now adjacent second side 48 of blade 14. Washers 50, 52, shown in FIG. 2, may also be included with bolts 32, 34. Alternatively, two separate apparatus 10 could be kept on hand at a work site, with one apparatus 10 having guide 20 on first side 46 of blade 14 for grading one side of the roadway, and the second apparatus 10 having guide 18 placed on second side 48 of blade being used to grade the opposite side of the roadway. As yet another alternative, two guide members 20 could be included on apparatus 10 simultaneously, if desired, with one on each side 46, 48 of blade 14.

Guide 20 may be positioned on blade 14 with first alignment edge 26 facing downward, as shown in FIG. 1 and 2, or with second alignment edge 28 facing downward, by inverting the position of guide 20 relative to blade 14 and the apparatus 10. Inverting the position of guide 20 allows the apparatus 10 to be employed with higher curb or slab structures than is possible when guide 20 is positioned as shown in FIG. 1 and 2. As related above, the generally L-shaped configuration of guide 20 as shown in FIG. 1 and FIG. 2 is but one of many possible shapes and configurations possible for the guide means used with the invention, and the structures and configurations of the guide means as disclosed herein are merely the presently preferred embodiments of the guide means of the invention and should not be construed as limiting.

The apparatus 10 as shown in FIG. 1 and FIG. 2 depicts handle 12 and blade 14 oriented in a generally planar configuration resembling that of a common shovel. Arrangements in which blade 12 and 14 are not coplanar, however, but are separated by an angle, in a configuration similar to a conventional hoe or the like, are also considered as within the scope of the present disclosure.

Figure 3:
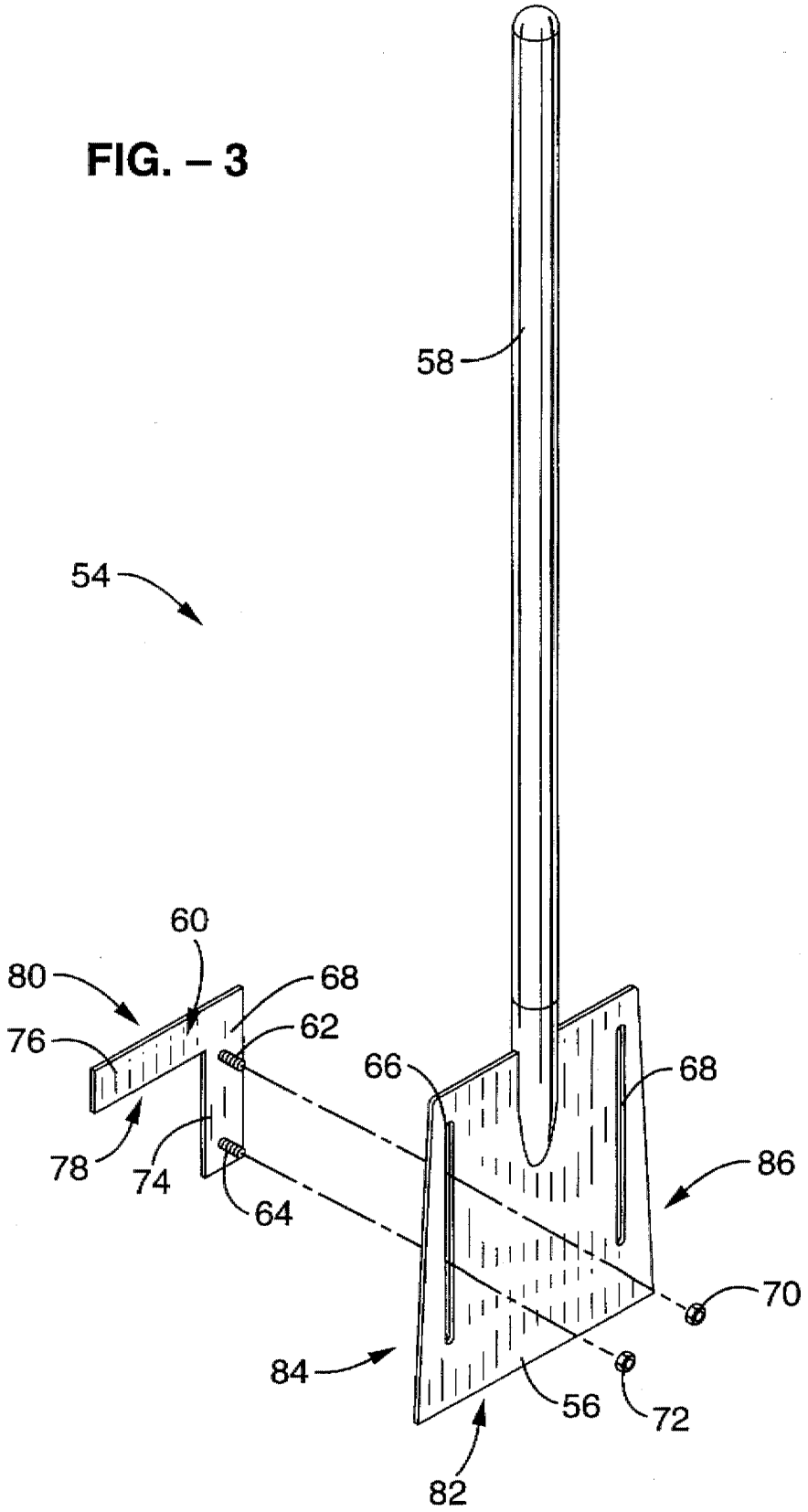
FIG. 3 is an exploded view of an alternative embodiment of the apparatus shown in FIG. 1.

Referring next to FIG. 3, there is shown a second embodiment of the invention as apparatus 54. Apparatus 54 comprises soil displacing means which includes a blade 56 and an elongated handle 58 attached to blade 56. Guide 60 serves as guide means, and fasteners or bolts 62, 64 on guide 60 serve as coupling means for attaching guide 60 to blade 56. Slots 66, 68 in blade 56 provide positioning means for guide 60, and bolts 62, 64 on guide 60 slidably engage slot 66 or slot 68, and couple thereto by nuts 70, 72 and/or other standard fastening means, such as washers (not shown) and the like. Guide 60 has a vertical arm 74 and a horizontal arm 76, with first and second alignment surfaces 78, 80 included on guide horizontal arm 76. First alignment surface 78 faces downward and is generally planar with or parallel to a downward or bottom edge 82 on blade 56.

The apparatus 54 shown in FIG. 3 is employed in generally the same manner as related above for apparatus 10 shown in FIG. 1 and FIG. 2, with the primary difference between the two embodiments being the location of the coupling means and the positioning means. Apparatus 54 in FIG. 3 includes slots 66, 68 on blade 56 rather than on guide 60 as in the first embodiment, and has bolts 62, 64 placed on guide 60 rather than on blade 56. As in the first embodiment, the position of guide 60 may be inverted relative to the position of guide 60 as shown in FIG. 3, so that second alignment surface or edge 80 faces downward rather than first alignment surface or edge 78. Bolts 62, 64 on guide 60 may be engaged in either slot 66 adjacent first side 84 of blade 56, as generally shown in FIG. 3, or in slot 68 adjacent second side 86 of blade 56, so that grading may be carried out adjacent to opposing curbs or gutters. It is also contemplated that two guides 60 could be simultaneously included on blade 56, using both slots 66, 68.

Figure 4:
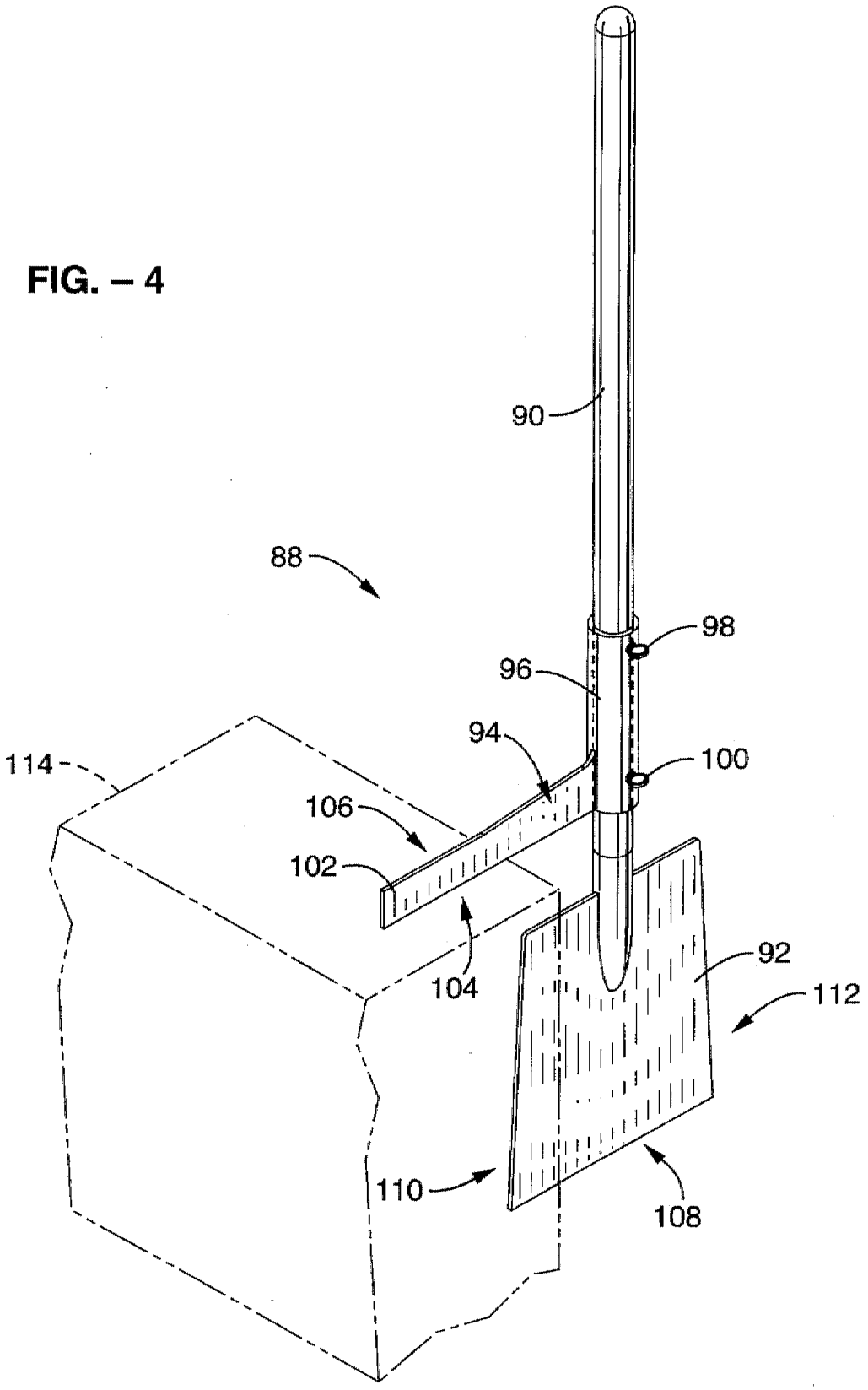
FIG. 4 is a perspective view of a third embodiment of the invention.

Shown in FIG. 4 is a third embodiment of the present invention wherein the coupling means and positioning means of the invention are associated with the handle portion of the soil displacing means of the invention rather than the blade portion, as related above in the first and second embodiments. The grading apparatus 88 shown in FIG. 4 includes an elongated handle 90 and a blade 92. Guide 94 includes a vertical sleeve 96 with a central bore (not shown) which slidably accommodates handle 90 and serves as positioning means. Vertical sleeve 96 includes at least two threaded bolts or set screws 98, 100 which pass through threaded holes (not shown) in vertical sleeve 96 to tensionally engage handle 90, thereby serving as coupling means for guide 94. Guide 94 includes a horizontal arm 102, with first and second alignment edges 104, 106 present on horizontal arm 102.

The third embodiment of the invention is used by loosening set screws 98, 100, and sliding guide sleeve 96 vertically along handle 90 until a desired distance between first alignment edge 104 and a downward edge 108 of blade 92 has been reached. Set screws 98, 100 are then tightened until they tensionally engage handle 90 and hold guide 94 in place. When set screws 98, 100 are loosened, guide 94 may be pivoted about handle 90 so that guide 94 may be used on either side 110, 112 of blade 92, permitting apparatus 88 to provide grading adjacent opposing curb structures. Guide 94 may be disengaged from handle 90 by sliding completely off, so that guide 94 may be inverted and replaced on handle 90 with second alignment edge 106 facing downward towards curb 114 rather than first alignment edge 104, as shown in FIG. 4, thereby allowing the apparatus 88 to accommodate taller curb structures. The apparatus 88 is otherwise used in a like manner to that as related above.

As is generally understood by persons of ordinary skill in the art, a large variety of coupling means and positioning means may be employed with devices such as the grading apparatus comprising the present invention. Such coupling means and positioning means, as well as the guide means, may be included on various portions of the apparatus, including, but not limited to, the blade and handle portions. For example, the positioning means and coupling means related in the fist and second embodiments of the invention may also be employed with the third embodiment shown generally in FIG. 4. Vertical sleeve 96 could include a vertical slot rather than set screws, and bolts could be included on handle 90, with the vertical slot slidably engaging the bolts in a like manner to that related above for the first and second embodiments of the invention. Alternatively, a vertical slot could be included along handle 90, which slidably engages bolts on vertical sleeve 96. Vertical sleeve 96 could alternatively be replaced by a vertical arm, as described above in the first and second embodiments, and thus guide 94 need not engage handle 58 in a wrap-around manner, or be rotatably mounted thereto, as shown generally in FIG. 4. Yet another form of positioning and coupling means could comprise a plurality of studs on guide 94 which would engage a plurality of bores included on handle 90, or alternatively the studs could be included on handle 90, and the bores included on guide 94.

Figure 5:
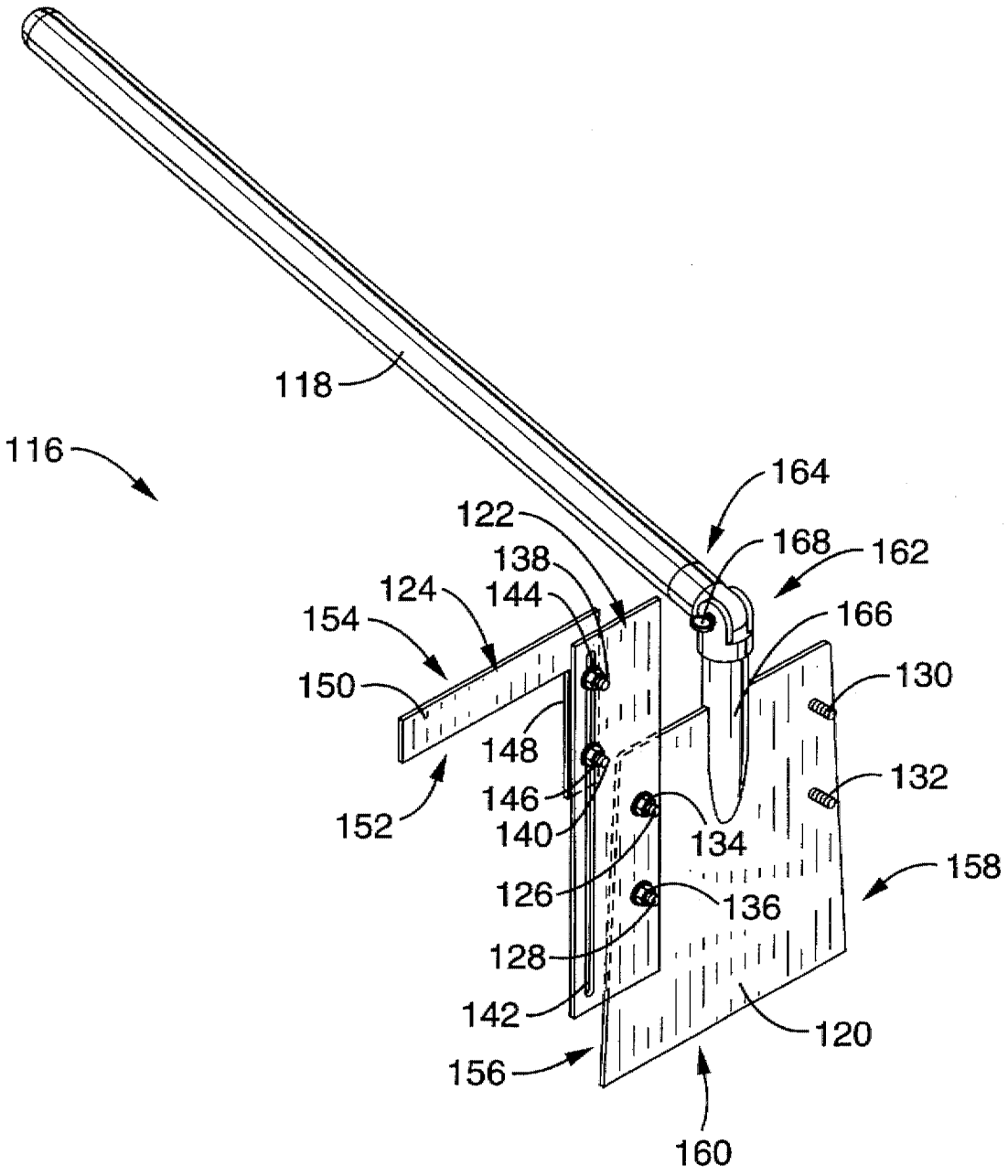
FIG. 5 is a perspective view of a fourth embodiment of the invention.

Referring now to FIG. 5, there is shown a fourth embodiment of a grading apparatus 116 in accordance with the present invention. In this embodiment, the soil displacing means includes an elongated handle 118 which is shown at an angle relative to blade 120, rather than generally planar with the blade 120 as related in the aforementioned embodiments of the invention. The guide means comprises two members, a first guide member 122 which couples to blade 120, and a second guide member 124 adjustably coupled to first guide member 122. The coupling means comprises a plurality of bolts 126, 128, 130, 132 on blade 120, which include fastening means in the form of nuts 134, 136, shown fastened to bolts 126, 128. The coupling means also comprises at least two bolts 138, 140 on second guide member 124. The positioning means is preferably a vertical slot 142 in first guide member 122, which slidably associates with bolts 138, 140, and fasten or attach thereto by nuts 144, 146 or like attachment means. Second guide member 124 includes a vertical arm 148 and a horizontal arm 150, with first and second alignment edges or surfaces 152, 154 included on horizontal arm 150.

As with the other embodiments of the invention, the guide means, as well as the positioning and coupling means, may comprise a variety of structures and configurations, and may be included on the invention at a variety of locations. The position of second guide member 124 may be inverted so that second alignment edge 154 is facing downward. It is also contemplated that first guide member 120 could be coupled to handle 118 rather than to blade 120, or that guide means could be employed on both sides 156, 158 of blade 120. A vertical slot could be included on second guide member 124, and the slidably engaging bolts could be included on first guide member 122, to achieve the same effect as provided by the apparatus 116 as shown in FIG. 5. The positioning means could additionally comprise another vertical slot on the first guide member 122, which would slidably engage bolts 126, 128 or 130, 132, thereby providing an expanded range of possible vertical adjustment for second guide member 124.

The angle of handle 118 relative to blade 120 shown in apparatus 116 allows a user to push as well as pull apparatus 116 along a curb, gutter, or like structure, in order to effect grading. The embodiment of the invention shown in FIG. 5 is thus well suited for grading areas where curb structures form right angles or are otherwise difficult to grade. The other embodiments of the invention disclosed herein may similarly employ a handle and blade which, rather than being generally coplanar as shown in FIG. 1 through FIG. 4, are arranged at an angle as shown in FIG. 5, or at any other angle required.

The invention may also comprise pivoting means for adjusting the angle of handle 118 relative to blade 120. Apparatus 116 in FIG. 5 is shown to include such pivoting means in the form of pivot member 162 adjacent end 164 of handle 118 and top portion 166 of blade 120. By loosening set screw 168, the angle of handle 118 may be varied relative to blade 120, so that the apparatus 116 can assume a shovel-like or hoe-like configuration as desired, for a particular grading operation. Re-tightening of set screw 168 retains the chosen angle between handle 118 and blade 120. The pivoting means may also comprise a pintle and gudgeon configuration, a ball and socket arrangement, or other common hinge and pivoting means used in the art.

Figure 6:
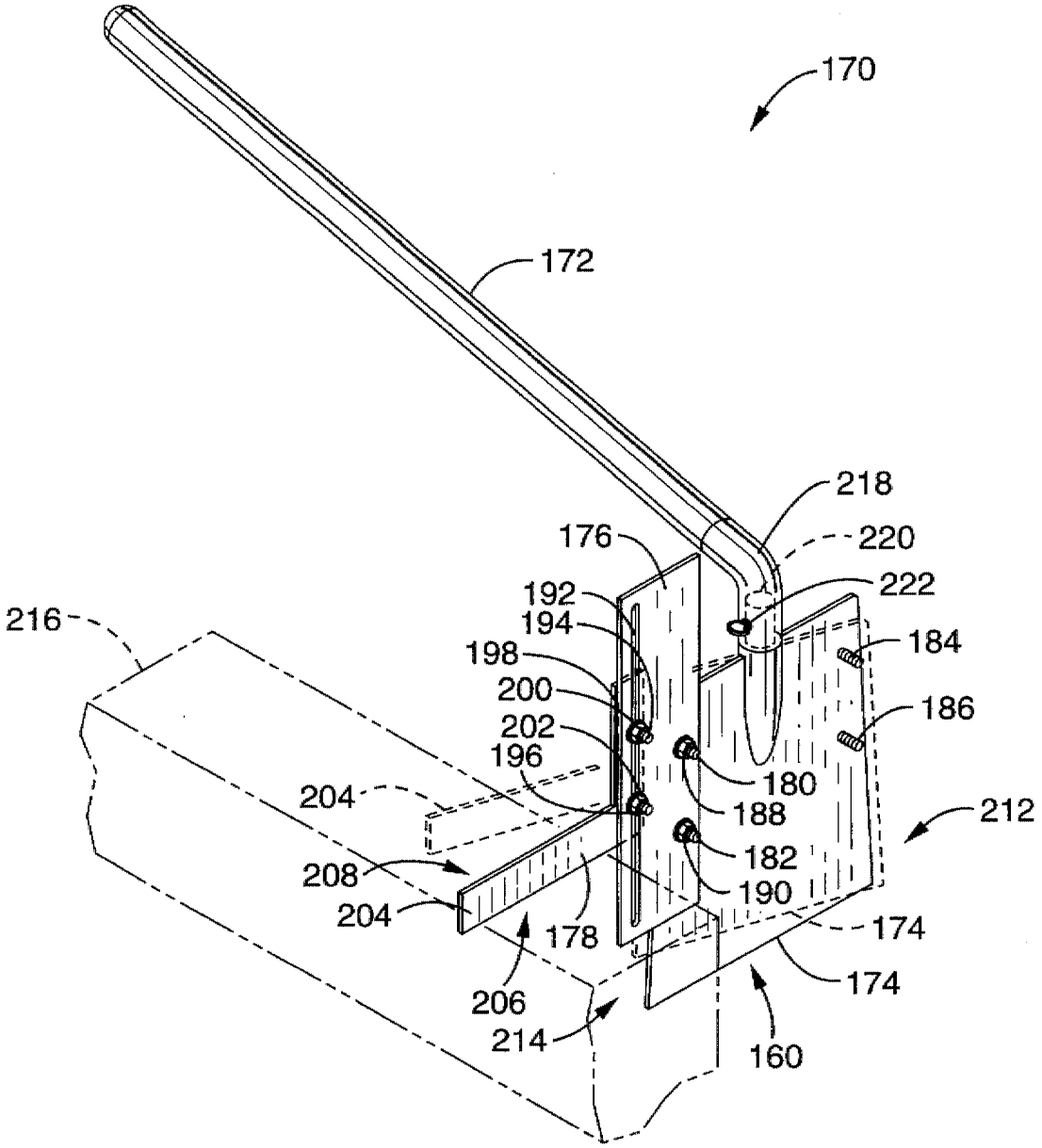
FIG. 6 is a perspective view of a fifth embodiment of the invention.

Referring now to FIG. 6, there is shown a fifth embodiment of the invention as apparatus 170, wherein soil displacement means comprises a handle 172 with a blade 174 coupled thereto. Guide means are provided in the form of a first guide member 176 and a second guide member 178. Blade 174 includes bolts 180, 182, 184, 186, and first guide member 176 is shown as coupled to bolts 180, 182 by nuts 188, 190. First guide member 176 includes a vertical slot 192, which slidably engages bolts 194, 196 on vertical arm 198 of second guide member 178 and fastens thereto by nuts 200, 202. Horizontal arm 204 of second guide member includes first and second alignment edges 206,208. Second guide member 178 may be inverted relative to the position shown in FIG. 6, so that second alignment edge 208 faces downward toward blade bottom edge 210, rather than first alignment edge 206, as shown. First guide member may alternatively coupled to bolts 184, 186 adjacent side 212 of blade 174, rather than to bolts 180, 182 adjacent side 214 of blade as shown in FIG. 6.

Apparatus 170 is shown to include pivoting means for adjusting the angle of blade 174 relative to an external surface feature such as curb 216. Handle end 218 is shown with a goose-neck shape, and includes a bore (not shown) which pivotally or rotatably engages top portion 220 of blade 174. Loosening of set screw 222 allows top portion 220 of blade 174 to pivot within the bore in handle end 218 for pivotal adjustment, while tightening of set screw 222 retains the adjusted position. Using this feature, the apparatus 170 may be used with a plow-like effect, pushing dirt or debris away from curb 216 in much the same manner as a snow plow is used to push snow off a road. The horizontal arm 204 of second guide member 178, which moves along curb 216 as the apparatus 170 is pushed by a laborer, hocks or removes any debris thereupon from the curb 216 and into the path of blade 174, which in turn diverts the debris away from the curb 216 in plow-fashion. By suitably adjusting the angle of blade 174 with the pivotal adjustment means, a plow effect may be obtained by pulling apparatus 116 rather than by pushing. The pivoting means may also comprise a pintle and gudgeon configuration, a ball and socket arrangement, or other common hinge and pivoting means used in the art. Those skilled in the art will appreciate that the pivoting means of FIG. 5 and FIG. 6 could be combined for even greater versatility.

Figure 7:
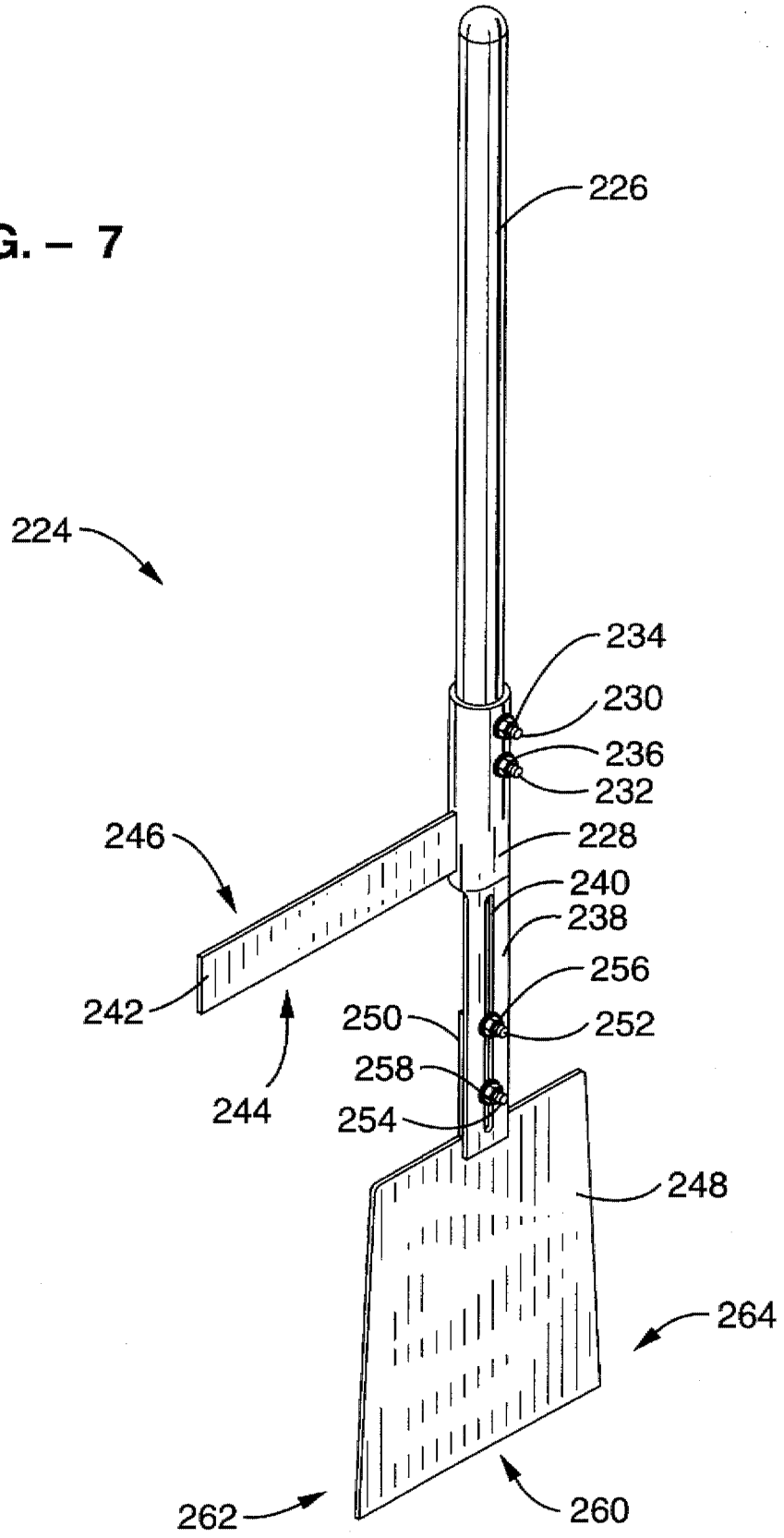
FIG. 7 is a perspective view of a sixth embodiment of the invention.

A fifth embodiment of the invention is shown generally in FIG. 7, wherein apparatus 224 wherein handle 226 is fixedly coupled to a guide member 228 by bolts 230, 232 and nuts 234, 236, or other standard attachment means. Guide 228 includes a vertical arm 238 with a slot 240, and a horizontal arm 242 with first and second alignment surfaces 244, 246. A blade 248 includes a relatively flat top portion 250 containing bolts 252, 254 which slidably engage slot 240 and attach thereto by nuts 256, 258 or other means. Positional adjustment of bolts 252, 254 within slot 240 allows adjustment of the distance between downward facing first alignment surface 244 and downward edge 260 of blade 248. Guide 228 may be positioned so that horizontal arm 194 is on either side 262, 264 of blade 248. Similarly, the slot 240 in vertical arm 238 of guide 228 could alternatively be included on handle 226 or blade 248, or alternative positioning and coupling means could be employed with apparatus 224 as related above. The embodiment shown in FIG. 7 illustrates that the handle and blade portions of the soil displacing means need not be coupled together, but may contain additional structural elements.

Figure 8:
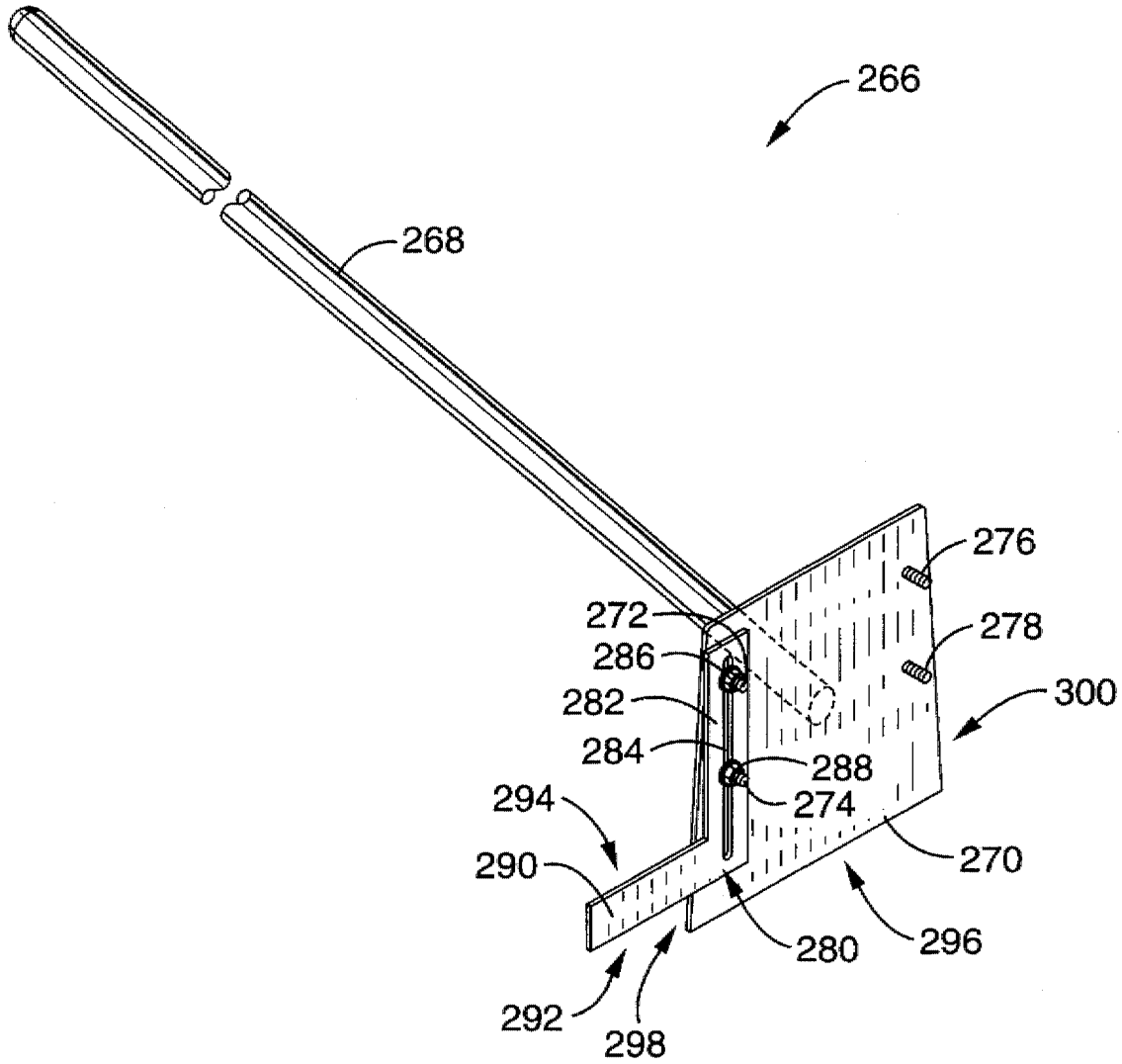
FIG. 8 is a perspective view of a seventh embodiment of the invention.

Referring next to FIG. 8, there is shown a seventh embodiment of the present invention as apparatus 266. In this embodiment, the handle 268 is coupled to blade 270 generally adjacent to the center of blade 270, to illustrate yet another possible arrangement of the soil displacing means, which generally comprises a blade portion and handle portion which may be attached together in any useful manner. Blade 270 includes protrusions or bolts 272, 274, 276, 278. Guide 280 includes a vertical arm 282 with a slot 284 which slidably engages bolts 272, 274, and is fixed in position by nuts 286, 288. Horizontal arm 290 of guide 280 includes first and second alignment edges 292, 294, and is shown in FIG. 8 with first alignment edge 292 facing downward and generally parallel with the downward edge 296 of blade 270. As with the other embodiments of the invention described above, guide 280 may be inverted so that second alignment edge 294 faces downward, or guide 280 may be included on either side 298,300 of blade 270. Otherwise, the apparatus 266 is used in a manner similar to that described above for the other embodiments of the invention.

Pivoting adjustment means as illustrated in FIG. 5 and FIG. 6 may optionally be included with any embodiment of the present invention to allow variation of the angle between the blade and handle portions of the soil displacing means or the angle of the blade relative to a curb. Thus, each embodiment of the invention disclosed herein could have a handle and blade at varying, adjustable angles relative to each other, so that if a user wished to push or pull the grading apparatus comprising the invention for a particular application, the apparatus could be suitably adjusted therefor. Similarly, pivot means for adjusting the angle of the blade relative to the curb, gutter, or other external feature may be adjusted to allow the invention to be used for grading in a plow-like fashion or in a scraping fashion.

The embodiments disclosed herein relate a variety of specific structures and configurations for guide means, coupling means, and positioning means, and are provided for illustrative purposes only, and not as limitations on the scope of the present invention. As related above in describing the individual embodiments, and is understood by persons of ordinary skill in the art, a variety of guide configurations may be employed, depending on the particular grading operation to be carried out, and a variety of coupling means and positioning means may similarly be employed.

The means for displacing soil generally comprises a handle portion and a blade portion, as related above. However, the soil displacing means may also include protrusions, rods, plates, or other features in addition to a handle and a blade, which may also be used to couple to the guide means of the present invention. FIG. 8 shows an arrangement wherein a handle is coupled directly to the face of a blade adjacent to the center of the blade, while the other embodiments show generally a handle coupled to a blade adjacent to a top edge of the blade. The arrangement of the handle and blade portions of the soil displacement means, and the manner in which the handle and blade are joined together as illustrated in FIG. 1 through FIG. 8, are merely illustrative and should not be considered limiting. Any handle and blade arrangement useful for grading, is thus considered within the scope of the soil displacing means as disclosed herein.

While the means for coupling the guide means to the blade, handle, or other portions of soil displacing means of the grading apparatus have been related above generally in terms of nuts, bolts, and set screws, other coupling, fastening, and attachment means, such as clips, clamps, springs, welds, adhesives, and like means commonly used in the art may be employed with the invention to couple the guide means to the apparatus. The guide means may alternatively be an integral portion of the blade, handle, or other part of the soil displacing means or grading apparatus. The coupling means may be attached to standard, commercially available shovels or hoes so that guide means may be employed thereon.

The vertical positioning means for adjustably positioning the guide means relative to the blade and the apparatus, which has been described herein generally in terms of slidably adjusting slots and/or sleeves, may additionally comprise ratchet mechanisms, stud and bore arrangements, screw arrangements, and other common positioning means used in the art. The positioning means may be included on the blade, handle, guide means, or other part of the soil displacement means of the apparatus. The positioning means may be attached to standard, commercially available shovels or hoes so that guide means may be positionally adjusted thereon.

Since the invention is generally employed adjacent abrasive concrete surfaces, the guide means, as well as the positioning and coupling means, are preferably made of durable wear-resistant material which is also light weight. Steel, aluminum, or other metal or metal alloys, as well as wood, engineering resins and composites thereof, are presently preferred materials for the guide means of the invention.

Accordingly, it will be seen that the present invention provides a grading apparatus which provides quick and facile grading of surfaces adjacent to curbs, gutter, concrete slabs, and like features which generally is not graded by large equipment. Although the description above contains many specificities, these should not be construed as limiting the scope of the invention but as merely providing illustrations of some of the presently preferred embodiments of this invention. Thus, the scope of the invention should be determined by the appended claims and their legal equivalents.

What is claimed is:

1. A grading apparatus, comprising;

(a) displacing means for grading soil, said displacing means including a blade, said displacing means including a handle, said blade including an elongated, downwardly disposed grading edge;

(b) guide means for adjustably positioning said blade relative to an external surface feature, said guide means including a vertical slot;

(c) at least one horizontally disposed protrusion on said blade slidably associated with said vertical slot in said guide means; and (d) fastening means associated with said protrusion for attaching said blade to said guide means through said vertical slot in said guide means.

2. A grading apparatus as recited in claim 1, wherein said guide means includes a downwardly disposed edge, and said downwardly disposed grading edge on said blade is substantially parallel to said downwardly disposed edge on said guide means.

3. A grading apparatus as recited in claim 1, further comprising pivoting means for adjusting the angle of said handle relative to said blade from a hoe-like structure and configuration to a shovel-like structure and configuration.

4. A grading apparatus as recited in claim 1, further comprising pivoting means for adjusting the angle of said blade to a plow-like structure and configuration relative to an external feature.

5. A grading apparatus, comprising;

(a) displacing means for grading soil, said displacing means including a blade, said displacing means including a handle, said blade including an elongated, downwardly disposed grading edge, said blade including a vertical slot;

(b) guide means for adjustably positioning said blade relative to an external surface feature;

(c) at least one horizontally disposed protrusion on said guide means slidably associated with said vertical slot in said blade; and (d) fastening means associated with said protrusion for attaching said guide means to said blade through said vertical slot in said blade.

6. A grading apparatus as recited in claim 5, wherein said guide means includes a downwardly disposed edge, and said downwardly disposed grading edge on said blade is substantially parallel to said downwardly disposed edge on said guide means.

7. A grading apparatus as recited in claim 5, further comprising pivoting means for adjusting the angle of said handle relative to said blade from a hoe-like structure and configuration to a shovel-like structure and configuration.

8. A grading apparatus as recited in claim 5, further comprising pivoting means for adjusting the angle of said blade to a plow-like structure and configuration relative to an external feature.

9. A grading apparatus, comprising;

(a) a blade, said blade including an elongated, downwardly disposed grading edge;

(b) a handle, said handle coupled to said blade;

(c) a guide member, said guide member including a horizontal arm and a vertical arm, said guide member including a downwardly disposed edge, said downwardly disposed elongated grading edge on said blade being substantially parallel to said downwardly disposed edge on said guide means, said guide member including a vertical slot;

(d) at least one horizontally disposed protrusion on said blade slidably associated with said vertical slot in said guide member; and (e) fastening means associated with said protrusion for attaching said blade to said guide member through said vertical slot in said guide member.

10. A grading apparatus as recited in claim 9, further comprising pivoting means for adjusting the angle of said handle relative to said blade between a hoe-like structure and configuration and a shovel-like structure and configuration.

11. A grading apparatus as recited in claim 9, further comprising pivoting means for adjusting the angle of said blade to a plow-like structure and configuration relative to an external feature.

12. A grading apparatus, comprising;

(a) a blade, said blade including an elongated, downwardly disposed grading edge, said blade including a vertical slot;

(b) a handle, said handle coupled to said blade;

(c) a guide member, said guide member including a horizontal arm and a vertical arm, said guide member including a downwardly disposed edge, and said downwardly disposed elongated grading edge on said blade being substantially parallel to said downwardly disposed edge on said guide means; and (d) at least one horizontally disposed protrusion on said guide member slidably associated with said vertical slot in said blade; and (e) fastening means associated with said protrusion for attaching said guide member to said blade through said vertical slot in said blade.

13. A grading apparatus as recited in claim 12, further comprising pivoting means for adjusting the angle of said handle relative to said blade between a hoe-like structure and configuration and a shovel-like structure and configuration.

14. A grading apparatus as recited in claim 12, further comprising pivoting means for adjusting the angle of said blade to a plow-like structure and configuration relative to an external feature.

15. A grading apparatus, comprising;

(a) displacing means for grading soil, said displacing means including a blade, said displacing means including a handle, said blade including an elongated, downwardly disposed grading edge;

(b) a first guide member, said first guide member coupled to said blade;

(c) a second guide member, said second guide member coupled to said first guide member;

(d) at least one of said guide members including a horizontally disposed protrusion slidably associated with a vertical slot in said other guide member; and (e) fastening means associated with said protrusion for attaching said first guide member to said second guide member through said vertical slot.

16. A grading apparatus, comprising;

(a) displacing means for grading soil, said displacing means including a blade member, said displacing means including a handle, said blade including an elongated, downwardly disposed grading edge;

(b) a first guide member;

(c) coupling means for slidably coupling said first guide member to said blade member, said coupling means including a vertical slot in at least one of said blade and said first guide members, said coupling means further including a horizontally disposed protrusion on said other of said blade and said first guide members, said protrusion slidably associated with said vertical slot;

(c) a second guide member, said second guide member coupled to said first guide member; and (d) fastening means associated with said protrusion for attaching said first guide member to said blade member through said vertical slot.

* * * * *